US007329017B2

(12) United States Patent
Walker

(10) Patent No.: US 7,329,017 B2
(45) Date of Patent: Feb. 12, 2008

(54) PARABOLIC REFLECTOR PROTECTIVE INSERT

(75) Inventor: Philip Walker, Pacific Palisades, CA (US)

(73) Assignee: Profile Illumination, Inc., Pacific Palisades, CA (US)

( * ) Notice: Subject to any disclaimer, the term of this patent is extended or adjusted under 35 U.S.C. 154(b) by 99 days.

(21) Appl. No.: 11/263,247

(22) Filed: Oct. 31, 2005

(65) Prior Publication Data

US 2007/0095710 A1 May 3, 2007

(51) Int. Cl.
*G03B 15/02* (2006.01)

(52) U.S. Cl. ..... 362/3; 362/344; 362/369

(58) Field of Classification Search ..... 362/3, 362/10, 344, 369; 206/418; 277/630, 637, 277/628

See application file for complete search history.

(56) References Cited

U.S. PATENT DOCUMENTS

| | | | | | |
|---|---|---|---|---|---|
| 1,611,575 | A | * | 12/1926 | Aulbach | 206/418 |
| 1,982,319 | A | * | 11/1934 | Perry | 174/59 |
| 4,375,262 | A | | 3/1983 | Hrenyo | |
| 5,091,835 | A | | 2/1992 | Malek | |
| 5,127,649 | A | | 7/1992 | Carbonero | |
| 5,291,379 | A | | 3/1994 | Lu | |
| 5,461,554 | A | | 10/1995 | Leonetti | |
| 5,486,984 | A | * | 1/1996 | Miller | 362/560 |
| 5,536,998 | A | | 7/1996 | Sica | |
| 5,902,037 | A | * | 5/1999 | Turner et al. | 362/376 |
| 5,920,636 | A | | 7/1999 | Oliveira | |
| 5,947,592 | A | | 9/1999 | Barlow | |
| 6,155,695 | A | | 12/2000 | Sealy | |
| 6,231,208 | B1 | | 5/2001 | Dalton | |
| 6,325,528 | B1 | * | 12/2001 | Wittmeier et al. | 362/514 |
| 6,467,930 | B1 | * | 10/2002 | Frick | 362/202 |
| 6,502,962 | B1 | | 1/2003 | Menke | |
| 6,695,463 | B1 | * | 2/2004 | Hatfield, Jr. | 362/390 |
| 6,710,522 | B2 | | 3/2004 | Fransen | |
| D504,494 | S | | 4/2005 | Ide et al. | |
| 2003/0016537 | A1 | * | 1/2003 | Liu | 362/311 |
| 2004/0145908 | A1 | * | 7/2004 | Ognian et al. | 362/516 |

FOREIGN PATENT DOCUMENTS

| | | |
|---|---|---|
| DE | 4205442 | 11/1992 |

* cited by examiner

*Primary Examiner*—Thomas M. Sember
*Assistant Examiner*—Julie A. Shallenberger
(74) *Attorney, Agent, or Firm*—Stetina Brunda Garred & Brucker

(57) ABSTRACT

The present invention involves a method and apparatus of protecting a lighting element within a parabolic reflective housing. The apparatus involves a lighting element-protective member for use in within a light reflector housing cavity wherein lighting element protrudes into the cavity. A resilient body is provided and is selectively deformable to be frictionally engaged with the inner surface of the reflector housing. An aperture is formed in the resilient body for receiving the lighting element within said aperture. Thus the lighting element is protected within a foam sleeve which abuts the sides of the parabolic reflector for support. Also, method of protecting the lighting element is disclosed comprising the steps of: providing a selectively deformable resilient body; providing an aperture within the resilient body; and inserting the resilient body within the reflector such that the aperture receives and covers the lighting element.

22 Claims, 2 Drawing Sheets

PARABOLIC REFLECTOR PROTECTIVE INSERT

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates to securing and protecting lighting elements within reflective light housings. More particularly, the present invention is used in television and motion picture lighting applications wherein a foam body is inserted into parabolic reflectors to envelope and support the fragile globes and thereby protect the globes within the parabolic reflectors when the light is not in use.

The filming of motion pictures or television shows requires a constant light source with no flickering. Specially designed lighting elements or globes capable of producing such light are very expensive and highly specialized. Each globe may cost thousands of dollars, and some globes have been known to operate at temperatures as high as 600-800° C. (about 1100-1500° F.) (see Malek et al., U.S. Pat. No. 5,091,835, the substance of which is incorporated herein by reference). Although such globes provide the desired non-flickering light source, such globes are delicate and easily subject to damage. While the globe and supporting light housing are stationary, the risk of damage is less, however, when the movement of the light is required, which may be often in on location shoots, the risk of damage is greatly increased. The delicate nature and high cost of the globes makes their transportation a very man hour intensive and time consuming process.

For the transport of the lighting apparatus that is use with the aforementioned globes, the globes must be removed from their housing, and placed in a safe container to ensure they will not break. If left inside the supporting housing, the globe may crack, due to forces associated with transportation which will permanently damage the globe. Removing the globe from the housing is a delicate procedure that usually requires two specially trained lighting technicians. However, before the globe can be removed, it must be allowed to cool to a reasonable temperature so as to allow the lighting technicians to touch the globe. After the globe has cooled, it is carefully removed from the light housing and placed in a storage device to protect it during transportation. Once the globe arrives at the off-set location, and the light housing has been set up, the light technicians carefully remove the globes from the safe container, and install them into the housing.

As can be appreciated movement of such lights is very tedious, time consuming and expensive. Additionally, the removal procedure also contributes to globes breakage requiring expensive replacement, despite the extra care and protection. Therefore, a device that would protect the globe within the housing so as to allow transportation of the globe without removal from the light housing would be desirable.

BRIEF SUMMARY OF THE INVENTION

The present invention provides a more efficient manner of protecting globes within a light housing. Specifically, the present invention allows a user to easily secure and protect a globe used in the television and motion picture industry so as to allow for a quick and easy transport of the supporting lighting apparatus.

In accordance with the present invention there is provided a protective insert for protecting a globe within a light housing. The protective insert is comprised of a resilient body capable which may be constructed out of a foam material. The insert is sized and configured to fit in place when inserted within the light housing. The insert also has an aperture formed within the resilient body sized for receiving a portion of the length of the globe. When the protective insert is placed within the light housing, it is intended that the insert will surround the globe and secure it during transportation. The resilient body is formed from a heat resistant foam to allow coverage of the globe even before it has cooled completely.

After transportation, the light housing is placed in a location desirable for shooting the motion picture or television show. Once the housing is set, the insert is removed by gripping the first and second cutouts and pulling on the insert. Once the insert is removed, and the globe is alone in the light housing, a glass cover may be placed over the light housing. At this point, the globe can be illuminated. The insert has an attached reminder ribbon positioned to hang from the insert to remind the light technician to remove the insert from the light housing before placing the glass cover over the housing and illuminating the globe.

The present invention acts as a dampening instrument for protecting the globe. As the globe is transported, the dampening of the present invention absorbs any forces that may be damaging to the globe.

The present invention also comprises a method of protecting a globe within a housing. The method entails providing an aperture within a resilient body. The resilient body is then inserted within the light housing such that the globe is partially received in the aperture. The resilient body protects the globe during transport or storage. When the globe reaches its final destination, the resilient body is extracted from the light housing by pulling on the insert from an extraction cutout.

DETAILED DESCRIPTION OF THE INVENTION

Figure 1:
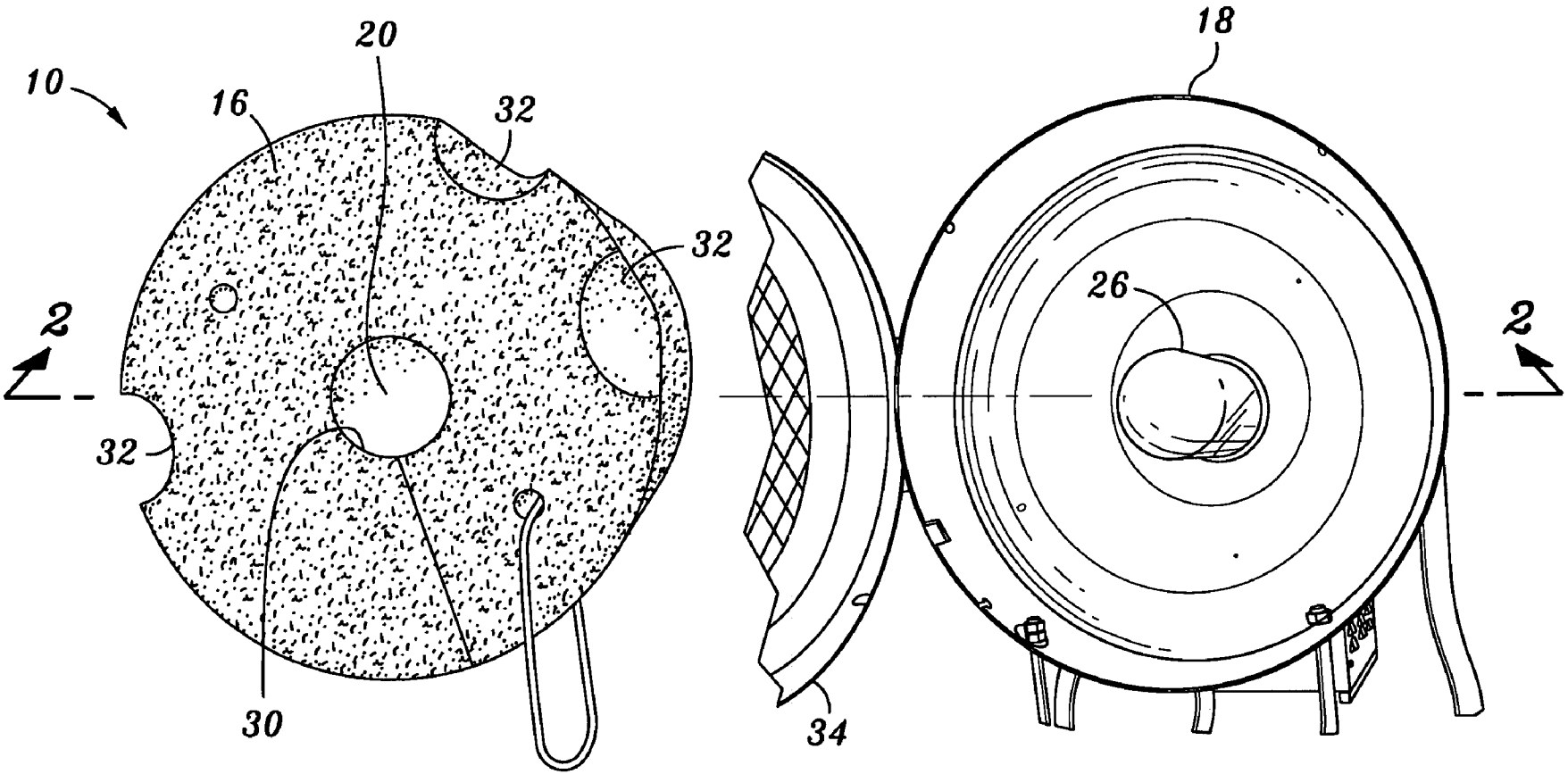
FIG. 1 is a perspective view showing the protective insert and the light housing.

Referring now to the drawings wherein the showings are for purposes of illustrating preferred embodiments of the present invention only, and not for purposes of limiting the same, FIGS. 1-4 illustrate a protective insert 10 constructed in accordance with the present invention. The insert 10 is intended to be placed within a light housing 18 having a globe 26 in order to protect the globe 26 during transport or storage. For purposes of this disclosure, the term "globe" means any species of lighting elements used with motion picture or television filming, or any other light element that might be protected by use of the device of the present invention. The invention is intended to be utilized on globes 26 commonly used in television and motion picture lighting applications.

The insert 10 comprises a resilient body 16 which is configured to fit in place when inserted within the light housing 18. The insert 10 has an upper surface 12 and a lower surface 14 and is sized such that it fits snuggly within the light housing 18. The insert 10 also comprises a first aperture 20 formed within the resilient body 16 sized for receiving a portion of the length of the globe 26. The resilient body 16 may be constructed of a foam material capable of withstanding the high temperatures generated by the globes 28. Globes 28 have been known to operate at temperatures ranging as high as 600° C.-800° C. The material must also be able to provide protection and support to the globe 28 during transport without scratching the inner surface of the light housing 18.

Figure 2:
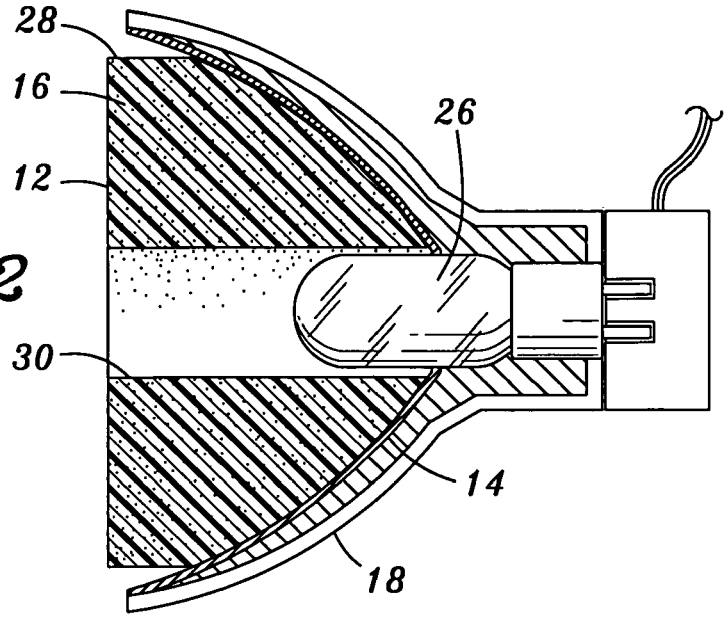
FIG. 2 is a cross-sectional view of the protective insert inside of the light housing taken along line 2-2 of FIG. 1.
Figure 3:
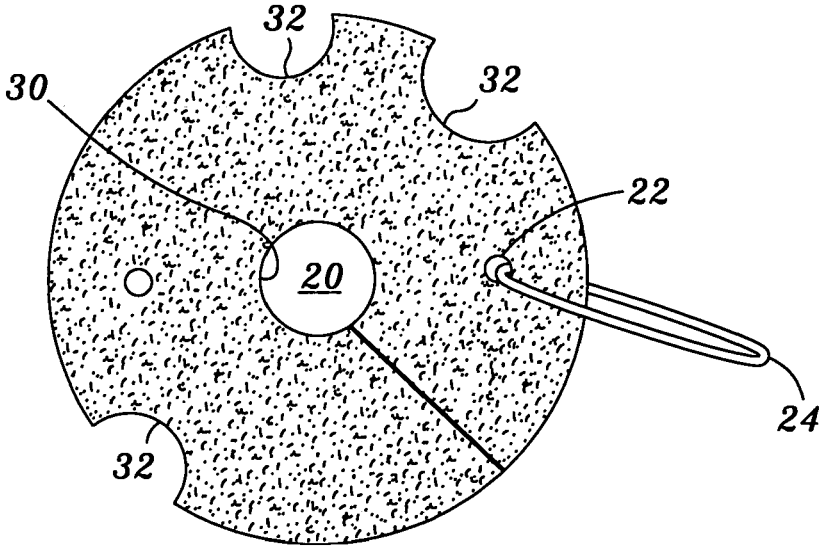
FIG. 3 is a top plan view of the protective insert.
Figure 4:
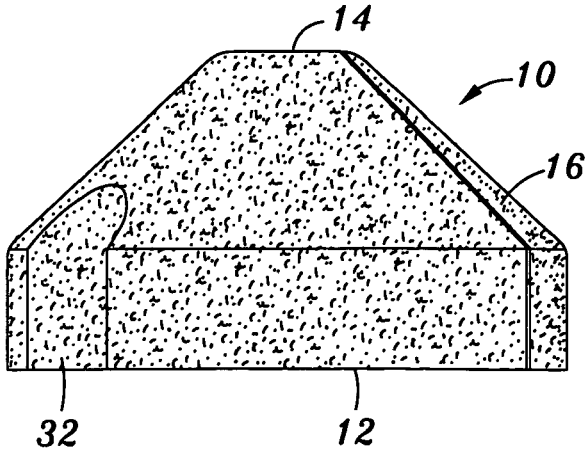
FIG. 4 is a side elevation view of the protective insert.

The cross-sectional view in FIG. 2 shows the insert 10 placed within the light housing 18. The insert 10 is sized and configured such that the outer surface 28 of the insert 10 abuts the light housing 18, while the inner surface 30 of the first aperture abuts the globe 26. Most light housings 18 used in television and motion picture lighting applications are substantially parabolic, however, it is understood that light housings 18 may be formed in many in different shapes and sizes. In such circumstances, the insert 10 will be sized and configured to fit within the shape and size of the light housing 18. Preferably, the depth of the insert 10 will be deeper than the length of the globe 26, as shown in FIG. 2, so as to completely shield it from damaging forces or debris. However, the insert 10 may provide support by only covering a portion of the globe 26, in which case, a section of the globe 26 would protrude out from the insert 10.

After transport or storage of the globe 26, the protective insert 10 is removed from the light housing 18. The resilient body 16 comprises an extraction cutout(s) 32 so as provide a location for a lighting technician to grip the insert 10 so that it may be removed from the light housing 18. Once the insert 10 is removed, a glass cover 34 is placed over the open end of the light housing 18. However, if the lighting technician does not remember to remove the insert 10 from the light housing 18, the insert 10 will preferably have a reminder member 24 attached to a second aperture 22 located on the resilient body 16. The reminder member 24 reminds the lighting technician to remove the insert 10 from the light housing 18 before placing the glass cover 34 over the light housing 18. In the preferred embodiment of the present invention, the reminder member 24 is comprised of a ribbon material.

Further in accordance with the present invention, there is provided a method of protecting a globe 26 within a light housing 18. The first step of the method is to provide a first aperture 20 within a resilient body 16. The resilient body 16 is then inserted within the light housing 18 such that the globe 26 is partially received within the first aperture 20, and the outer surface 28 of the resilient body 16 abuts the light housing 18. The dimension of the first aperture 20 should allow the globe 26 to snuggly fit and contact the inner surface of the first aperture 20 when the resilient body 16 is placed within the light housing 18.

The present invention may also be used as a dampening instrument 10 for protecting the globe 26, where the globe 26 is partially received into the dampening instrument 10. The dampening instrument 10 is comprised of a resilient body 16 capable of absorbing any damaging forces. The resilient body 16 has a first aperture 20 defined by an inner surface 30 which is in contact with the globe 26. The dampening instrument 10 also has an outer surface 28 in contact with the light housing 18.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. In a motion picture or television lighting apparatus having a reflector which includes an inner surface defining a cavity and a lighting element which is cooperatively engaged with the reflector and protrudes into the cavity, the improvement comprising:

a resilient body selectively deformable into frictional engagement with at least a portion of the inner surface of the reflector and the lighting element said resilient body further comprising at least one gripping cutout disposed in spaced relation to a portion of the inner surface of the reflector operative to enable extraction of the resilient body from the reflector.

2. The resilient body of claim 1 further comprising an aperture for receiving a least a portion of the lighting element within said aperture.

3. The resilient body of claim 2 wherein the resilient body is defined by a contact surface for contacting the inner surface of the reflector and an outer surface which does not contact the inner surface of the reflector.

4. The resilient body of claim 3 wherein said aperture extends though the length of the resilient body from the contact surface to the outer surface.

5. The resilient body of claim 2 wherein said aperture is defined by a cylindrical sidewall, said cylindrical sidewall for engaging the surface of the lighting element.

6. The resilient body of claim 1 further comprising a flexible member extending from the resilient body to operate as a reminder that the resilient body is within the reflector.

7. The resilient body of claim 6 wherein the flexible member is a ribbon.

8. The resilient body of claim 2 wherein the aperture extends partially through the insert.

9. The resilient body of claim 1 wherein the resilient body is constructed of a foam material.

10. The resilient body of claim 1 wherein the reflector is substantially parabolic.

11. A method of protecting a lighting element within a reflector, the method comprising the steps of:

a. providing selectively deformable resilient body;

b. providing an aperture within the resilient body;

c. inserting the resilient body within the reflector such that the aperture receives and covers at least a portion of the lighting element and frictionally engages at least a portion of an inner surface of the reflector; and d. extracting the resilient body from the reflector by pulling the resilient body by an extraction cutout formed in the resilient body.

12. The method as recited in claim 11 wherein the resilient body is constructed of a foam material.

13. The method as recited in claim 11 wherein the light housing is substantially parabolic.

14. A lighting element protective member for use in within a light reflector housing, said reflector housing having a reflector inner surface defining a cavity and a lighting element which is cooperatively engaged with the reflector housing and protrudes into the cavity, said protective member comprising;

a resilient body selectively deformable into frictional engagement with at least a portion of the inner surface of the reflector housing;

an aperture formed in said resilient body for receiving a least a portion of the lighting element within said aperture; and at least one gripping cutout formed in said resilient body and when said resilient body is inserted within said reflector housing said cutout is disposed in spaced relation to a portion of the inner surface of the reflector operative to enable extraction of the resilient body from the reflector.

15. The resilient body of claim 14 wherein the resilient body is defined by a contact surface for contacting the inner surface of the reflector and an outer surface which does not contact the inner surface of the reflector.

16. The resilient body of claim 15 wherein said aperture extends though the length of the resilient body from the contact surface to the outer surface.

17. The resilient body of claim 15 wherein said aperture is defined by a cylindrical sidewall, said cylindrical sidewall for engaging the surface of the lighting element.

18. The resilient body of claim 14 further comprising a flexible member extending from the resilient body to operate as a reminder that the resilient body is within the reflector.

19. The resilient body of claim 18 wherein the flexible member is a ribbon.

20. The resilient body of claim 15 wherein the aperture extends partially through the insert.

21. The resilient body of claim 14 wherein the resilient body is constructed of a foam material.

22. The resilient body of claim 14 wherein the reflector housing is substantially parabolic.

* * * * *